United States Patent [19]

Rüsing et al.

[11] Patent Number: 4,479,592

[45] Date of Patent: Oct. 30, 1984

[54] DISPENSER

[75] Inventors: Arnold E. Rüsing, Radevormwald; Alfred von Schuckmann, Kevelaer, both of Fed. Rep. of Germany

[73] Assignees: Blendax-Werke R. Schneider GmbH & Co.; Mega Products-und Verpackungsentwicklung Marketing GmbH & Co., KG, both of Fed. Rep. of Germany

[21] Appl. No.: 522,241

[22] Filed: Aug. 10, 1983

Related U.S. Application Data

[63] Continuation of Ser. No. 321,040, Nov. 13, 1981, abandoned.

[30] Foreign Application Priority Data

Nov. 26, 1980 [DE] Fed. Rep. of Germany ..... 3044439
Jun. 26, 1981 [DE] Fed. Rep. of Germany ..... 3125092

[51] Int. Cl.[3] ..... G01F 11/00

[52] U.S. Cl. ..... 222/319; 222/336; 222/391

[58] Field of Search ..... 222/391, 341, 340, 402.1, 222/402.13, 402.15, 319, 336, 372, 386; 74/128, 160

[56] References Cited

U.S. PATENT DOCUMENTS

| | | | |
|---|---|---|---|
| 1,212,010 | 1/1917 | Brown | 222/391 X |
| 2,356,874 | 8/1944 | Nageotte | 222/391 X |
| 2,685,989 | 8/1954 | Samuels | 222/402.13 |
| 3,143,254 | 8/1964 | Vanderhyde | 222/402.13 X |
| 3,255,935 | 6/1966 | Spatz | 222/391 X |
| 3,858,762 | 1/1975 | Meshberg | 222/402.13 X |
| 3,870,200 | 3/1975 | Spatz | 222/386 X |
| 4,225,060 | 9/1980 | Kutik et al. | 222/340 X |
| 4,301,948 | 11/1981 | Czech et al. | 222/341 |
| 4,413,759 | 11/1983 | Mettenbrink | 222/391 X |
| 4,421,255 | 12/1983 | Czech | 222/391 X |
| 4,437,591 | 3/1984 | von Schuckmann | 222/391 |

FOREIGN PATENT DOCUMENTS

| | | | |
|---|---|---|---|
| 797113 | 4/1936 | France | 222/391 |
| 576603 | 6/1976 | Switzerland | 222/402.13 |
| 2076473 | 12/1981 | United Kingdom | 222/391 |

*Primary Examiner*—Joseph J. Rolla
*Assistant Examiner*—Kevin P. Shaver
*Attorney, Agent, or Firm*—Jordan B. Bierman

[57] ABSTRACT

The invention is directed to a dispenser of the type used for providing measured amounts of a paste, such as a toothpaste or shaving cream. A cylinder having a dispensing mouth but otherwise closed at the top is mounted for sliding movement within a casing in the bottom of which is a coiled spring and from which a piston rod extends upwardly toward the said mouth. A piston is slidably mounted on the piston rod with walls adjacent the inner wall of the cylinder, with a reed spring clip supporting the said piston. When the cylinder is pressed downwardly against the spring, the piston cannot move because of the gripping action of the reed spring clip and a predetermined amount of material is ejected from the mouth. Upon release of the cylinder, it moves upwardly under the force of the spring for a predetermined distance, and by action of the spring clip moves the piston upwardly. The parts are then in position for the next dispensing action.

19 Claims, 11 Drawing Figures

DISPENSER

This application is a continuation of application Ser. No. 321,040, filed Nov. 13, 1981, now abandoned.

The invention relates to a dispenser for the portion-wise dispensing of a material, in particular a paste, e.g. toothpaste, having a cylinder in which a piston moves stepwise relative to the cylinder in the direction toward an ejection opening, while in the opposite direction it is clampable on the inner wall of the cylinder by means of a clip type reed spring arranged thereon, the ejection opening being disposed at the same end of the dispenser at which the pressure is to be applied.

Such a dispenser has become known from DE-OS No. 2611644. Here the cylinder guiding the piston and containing the material serves at the same time as the external dispenser part to be gripped by the hand, and on its top side is mounted a dome-shaped rubber-elastic cap with an actuator mounted thereon and having the ejection opening. In the interior below the cap, a check valve is provided in the flow path of the material. The material is enclosed between the ejection opening and a piston guided in the cylinder. Below its bottom the piston carries a reed spring as a clip, the reeds of which, inclined approximately radially outward and slightly downward, can be brought into engagement with the inner jacket of the cylinder with their tips clamped, as soon as pressure is exerted on the piston from above. This arrangement prevents the piston from being moved downwardly under the compressive forces exerted on it from above, whereby air would be drawn into the dispenser, which however is to contain only the material to be dispensed. Below the reed spring is a cap which covers it for the most part and which together with the piston and the reed spring migrates toward the top-side ejection opening during use of the dispenser.

The mode of operation of this known device is as follows: When pressure is exerted on the actuator, the dome-shaped element becomes deformed because it is pushed in, and it reduces the volume of the dispenser in which the material is enclosed. The resulting pressure also exerted on the piston in the direction of the dispenser bottom is absorbed by the reed spring, so that the pressure can act only in the direction of the check valve, which is opened by it and causes the material to come out. If the actuator is let go again after the material has been dispensed, the cap, returning to its original form, creates a vacuum in the space enclosed by the material, with the result that the atmospheric pressure moves the piston up, as is readily possible because of the one-way locking mechanism of the reed spring.

The disadvantage of this known container is primarily in the way it handles. Thus the quantity of material dispensed depends on the volume reduction of the space enclosing the material, i.e. the quantity depends on the deformation of the elastic cap. Constant portioning is therefore not possible. As the actuator on the dome-shaped cap is movable in all directions, another disadvantage is that the actuator must be tilted relative to the handle on the outer jacket of the cylinder. A straight aimed pressure movement is therefore not possible, and the application of the material is thereby additionally made difficult.

It is the object of this invention, proceeding from the above-described state of the art, to design a dispenser according to the preamble of claim 1, in such an improved manner that combined with a simple actuation of constant direction on the side of the ejection opening, reproducibly equal portions of material can be dispensed by an easy one-hand operation.

The invention produces this result by mounting a cylinder for longitudinal displacement counter to the action of a return spring in a housing type container part which serves at the same time as a grip, and within which a piston rod is firmly connected at least indirectly, relative to which a piston is supportable by means of a clip in such a way that when a pressure on the topside of the cylinder causes the ejection of a portion, the piston is fixed at the piston rod, while during the return stroke of the cylinder the piston is fixed at the cylinder.

Because the cylinder receiving the material—being essentially a rigid part—is mounted for longitudinal displacement in the container housing serving as grip, the size of the portion to be ejected depends only on the easily obtainable constant stroke of the cylinder. Along the immobile piston rod the piston can move upwardly stepwise, its position relative to the outer container part being maintained upon pressure on the upper part of the cylinder, so that the desired portion of material is dispensed, while during the return stroke of the cylinder the piston moves a distance equivalent to a constant volume occupied by the material. Thus proportioning of the contents, e.g. toothpaste onto a toothbrush, is possible in a simple manner.

Unlike the known dispenser, the mode of operation of the dispenser of this invention is not dependent solely on the pressure difference between the atmosphere and the internal space, because to bring the cylinder back a return spring, e.g. a helical compression spring, is used. Hence no valve is needed. The spring may be made strong enough to loosen any incrustations or to overcome the retaining forces thereof. Besides, the return spring leads to a rapid resetting of the actuator sooner than a simple pressure equalization, thereby also confirming the justified impression of correct functioning subjectively.

It is indeed known from FR-PS No. 15 52 370 how to use, in a dispenser also intended for toothpaste, a double-action clamping mechanism in the form of a reed spring braced against the inside wall of the container on the one hand and against a piston rod on the other, and it is also known how to mount the actuator relative to the housing by means of a compression spring. Here, however, the actuator is a pushbutton countersunk in a collar of the container opposite the ejection opening, with which the piston rod is connected as a dynamic unit, so that the piston rod executes the reciprocating movements relative to the cylinder enclosing the material. The container known from FR-PS No. 15 52 370 is not suitable for use in such a way that, when set up on a support, it can be operated by finger pressure from above, as is readily possible with the dispenser of the present invention. Handling by gripping and actuating with the same hand is also difficult in the prior art arrangement, inasmuch as the material is ejected at the end of the container away from the actuating button. Additionally as it is practically possible only to actuate the pushbutton with a finger of the holding hand, usually the thumb, ejection will occur in the direction of the edge of the hand, thereby making an aimed application of the material on a support practically impossible.

An advantageous development of the dispenser according to the present invention consists in that the container part consists of a cylindrical body, the top part of which has a stop for limiting the cylinder return, and in the housing bottom on which the piston rod is expediently mounted. The bottom as a piston rod support can be connected with the lower end region of the cylinder as soon as all operationally necessary parts including the material and the cylinder have been introduced from that side. In addition, the bottom can serve as seat for the return spring.

The free end of the piston rod is expediently spaced from the top of the cylinder by a distance which is slightly greater than one portion stroke of the cylinder. Advantageously also the piston has a reduced upper section which—at least partially adapted in form—can be introduced into a reduced upper section of the cylinder to just below the top thereof. This makes it possible to evacuate the cylinder almost completely.

Another form of realization of the invention consists in that at least one flexible lip seal cooperating with the piston rod is associated with the piston bottom, that at a distance A from its free end the piston rod has a contracted section of length L, the sum of A and L being greater than the distance of the lip seal from the zone of engagement of the reed spring at the piston rod, and L being at least slightly greater than one portion stroke. These features ensure that the piston is securely guided along the piston rod to ejection of the last possible portion and, due to the lip seal, is sealed from the space accommodating the material also in the region of the constricted section, because the flexible lip seal, without losing its function, is effective also in the region of the constriction. However, when the reeds of the ring spring move into the region of the constriction, they lose contact with the piston rod, with the result that upon pressure onto the upper bottom of the cylinder, the piston now is taken along downwardly without additional material being dispensed. After the last possible portioning stroke, therefore, there results an arrangement where only idle strokes are carried out. As compared with a design where the further pressure actuation of the cylinder would no longer be possible due to abutment on the piston bottom, the design allowing only idle strokes conveys to the user the correct feeling of holding an empty container in his hand rather than a malfunctioning one.

Another advantageous form of the dispenser consists in that on the outside of the cylinder and on the inside of the container housing form-matching parts such as ledges, cams, grooves or the like, for instance in the form of an axial tooth system are arranged which prevent relative rotation of these parts with respect to their common longitudinal axis. Nonrotational fixation is especially advantageous when according to another embodiment of the invention the cylinder has at its upper end a thread arrangement for a cap nut, and protrudes by this threaded section from the container housing, the lower annular end face of the screw cover being adapted to take support on the upper end face of the container housing. It is achieved thereby that when screwing the cap on, the cylinder is brought back into its starting position by the screwing even if the cylinder should not have been reset or completely reset by the return spring. Since the piston is then taken along and there is no volume change in the space containing the material, there will be no undesired expulsion of material; it is achieved however that immediately upon the start of the next pressure movement material starts to come out of the ejection opening.

In connection with another feature, known in itself, which consists in that an inside face of the screw cover in the screwed-on position blocks the cross-section of the ejection opening, there results in combination with the preceding features the further advantage that when the cover is screwed on, the latter can quasi automatically bring the edge of the ejection opening under its sealing surface. If the cover and/or the material of the part surrounding the ejection opening is made to be somewhat flexible, there results an excellent sealing effect, which in any case can effectively prevent undue issuance of the material and desiccation thereof.

Further advantageous forms and developments of the invention will be evident also from the following description with reference to an embodiment illustrated in the drawings. The drawings show (approximately on a scale of 2:1)

FIG. 1, a partial longitudinal section through a filled dispenser according to this invention;

FIG. 2, a partial longitudinal section through the upper section of the same dispenser evacuated to the maximum extent possible;

Figure 1:
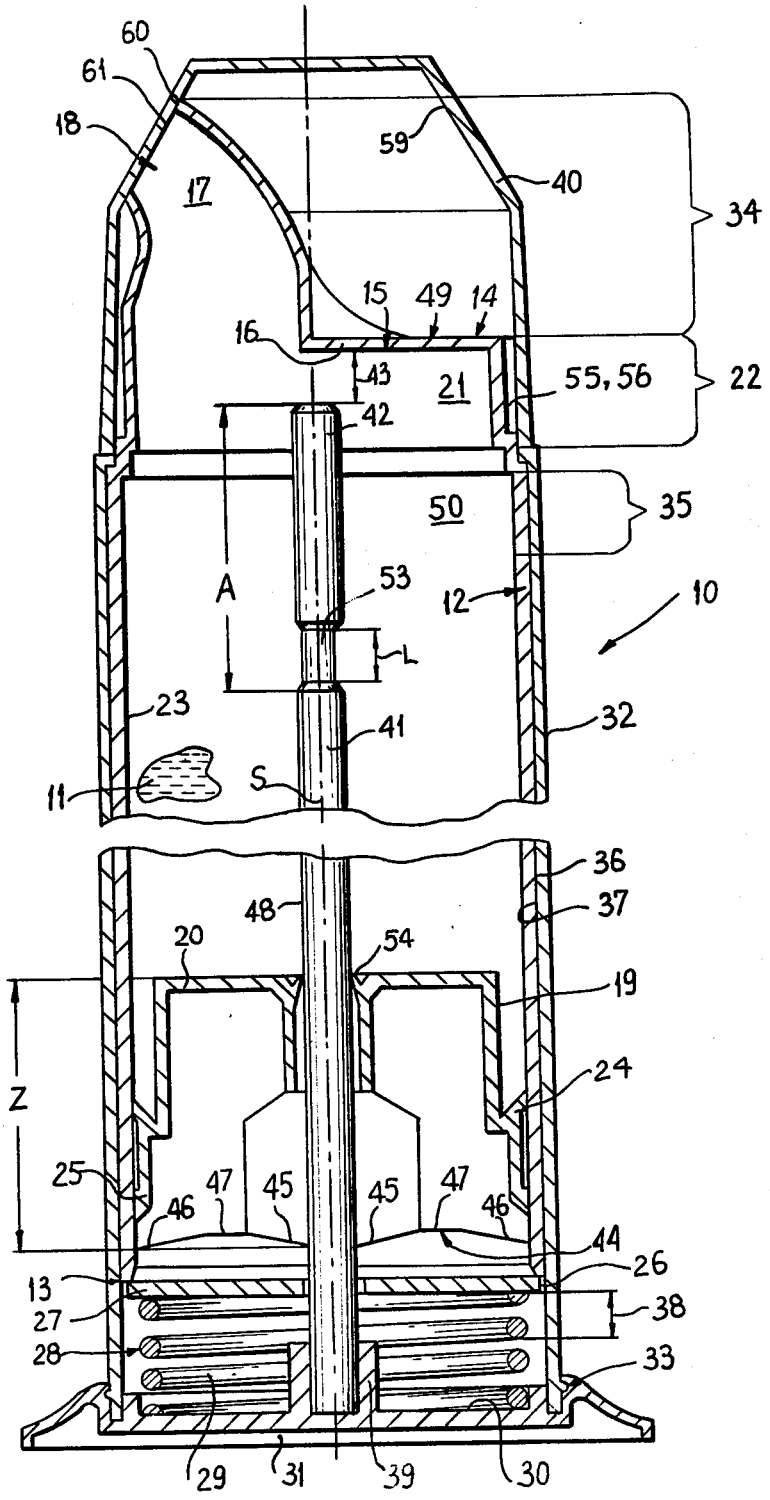

As shown in FIGS. 1–7, dispenser 10 has a cylinder 12 receiving the material 11, e.g. toothpaste, the underside 13 of the cylinder being open and its upper closure 14 having a straight section 16 serving as pushbutton 15, followed by a tubular dispensing channel 17 with dispensing opening 18 on one side. The material 11 is contained inside the cylinder 12 between the dispensing opening 18 and a piston 19. The latter's upper part 20 has a diameter smaller than the inside diameter of the cylinder 12 and a contour which permits it to enter into the interior 21 of a reduced upper section 22 of cylinder 12 formed below the pushbutton 15 (in particular FIG. 2). At the inner jacket 23 of cylinder 12 the piston 19 is guided with circling seal lips 24 and 25.

At the lower annular end face 26 of cylinder 12, a disk 27 is loosely inserted, on the underside of which a return spring 28 is supported, which is here formed as a helical compression spring 29. The second seat for the compression spring 28 is formed by the inner side 30 of the bottom 31 of a container part 32. Bottom 31 is coupled with the container part 32 by a plug connection, for which there is provided a snap arrangement 33 consisting of annular bead and annular groove.

The container part 32 is cylindrical and surrounds the cylinder 12 over almost its entire length, with the exception of its upper sections 22 and 34. Approximately in a region on the outside 36 of cylinder 12 and the inside 37 of the container part 32, matching, substantially axially oriented plugging means in the form of ribs and grooves or the like arrangements, (not shown) are provided, which prevent the cylinder 12 from turning around in the container part 32 about the longitudinal axis S. The length 35 to be provided in the direction of axis S is expediently greater than one portioning stroke.

The length of the portioning stroke results in, the described embodiment, from the distance 38 between the underside of the disk 27 and the topside of a collar 39 formed on the inner side 30 of bottom 31. In fact, after removal of the screw cap 40, the cylinder 12 can be moved downwardly relative to container part 32 counter to the action of the return spring 28, by the length of path 38 by pressure in the direction of arrow 49 on the pushbutton 15.

Fixed coaxially to the longitudinal median axis S in the collar 39 of bottom 31 is a piston rod 41. Its free end 42 ends at a distance 43 from the underside of the upper closure 14 of cylinder 12, this distance 43 being preferably somewhat greater than the portion stroke 38. The underside of the cylinder bottom 14 is thereby prevented from striking against the piston rod 41 before the maximum nominal stroke has been executed. But it would be possible also to let the length of the piston rod 41 limit the stroke. If the dimension 38 is greater than the dimension 43, the latter would determine the portion stroke.

To be able to move piston 19 stepwise in the direction of the ejection opening 18 for the purpose of dispensing material, the piston is connected at its underside by a reed spring 44 or the like, which respectively carries in an approximately radial arrangement inner reeds 45 and outer reeds 46 which are held together by a joint connecting ring 47. The inner reeds 45 as well as the outer reeds 46 are slightly inclined downwardly relative to the inner side 30 of the container bottom 31. The inner reeds 45 can clamp-lock with the outer surface 48 of piston rod 41, while the outer reeds can come into active contact with the inner surface 23 of cylinder 12.

Figure 2:
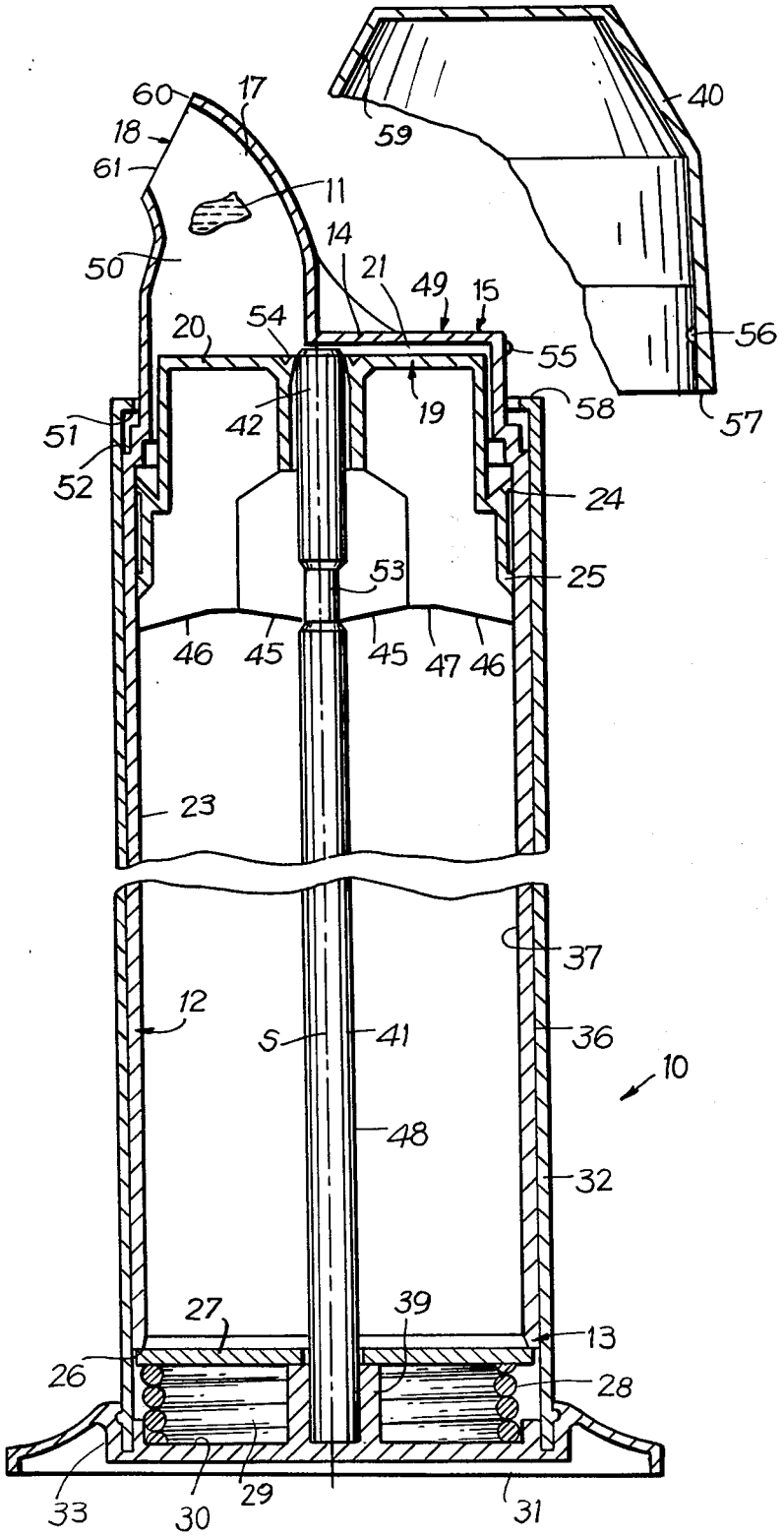
Figure 3:
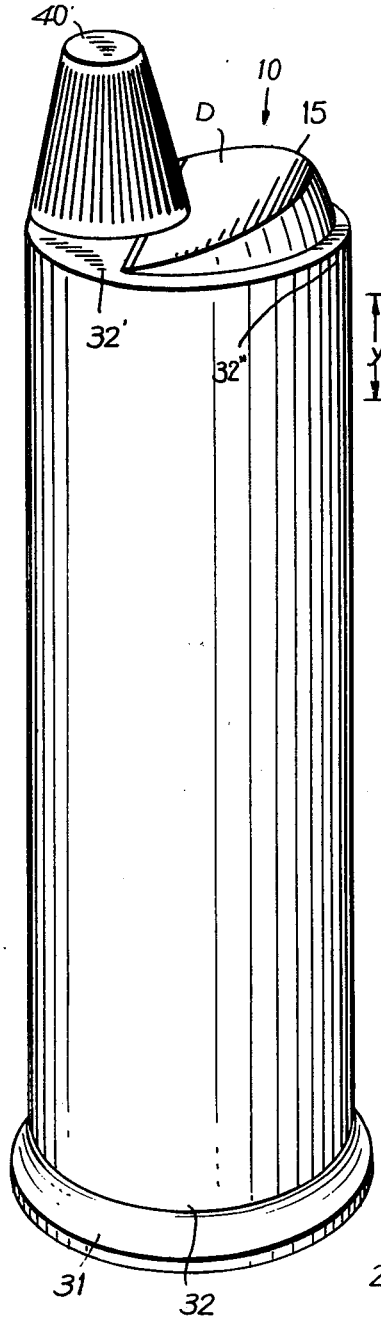
FIG. 3 shows in perspective another embodiment of the dispenser.
Figure 4:
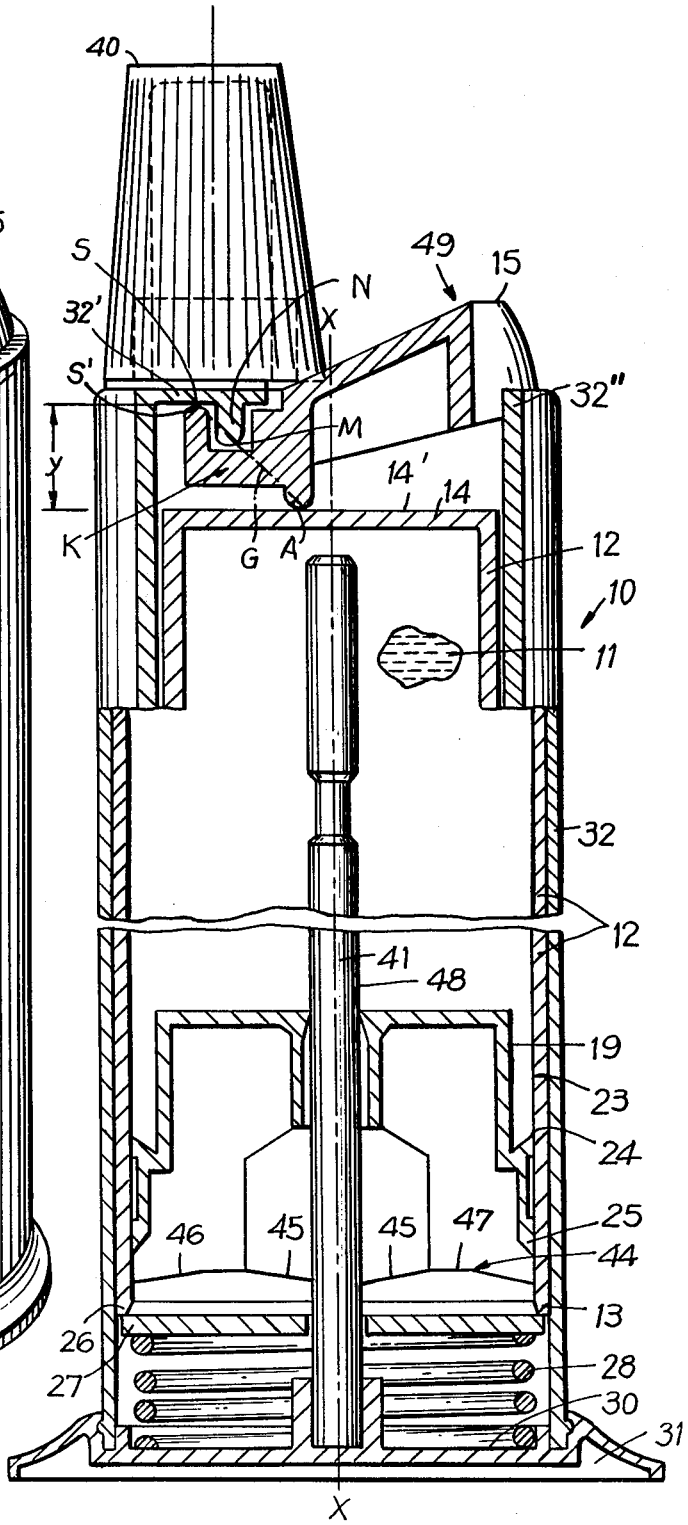
FIG. 4 shows this embodiment of the dispenser in longitudinal section, namely in the lower part in diametrical section along the line IV—IV in FIG. 5, and in the upper part in an offset parallel section along the line V—V in FIG. 5.
Figure 5:
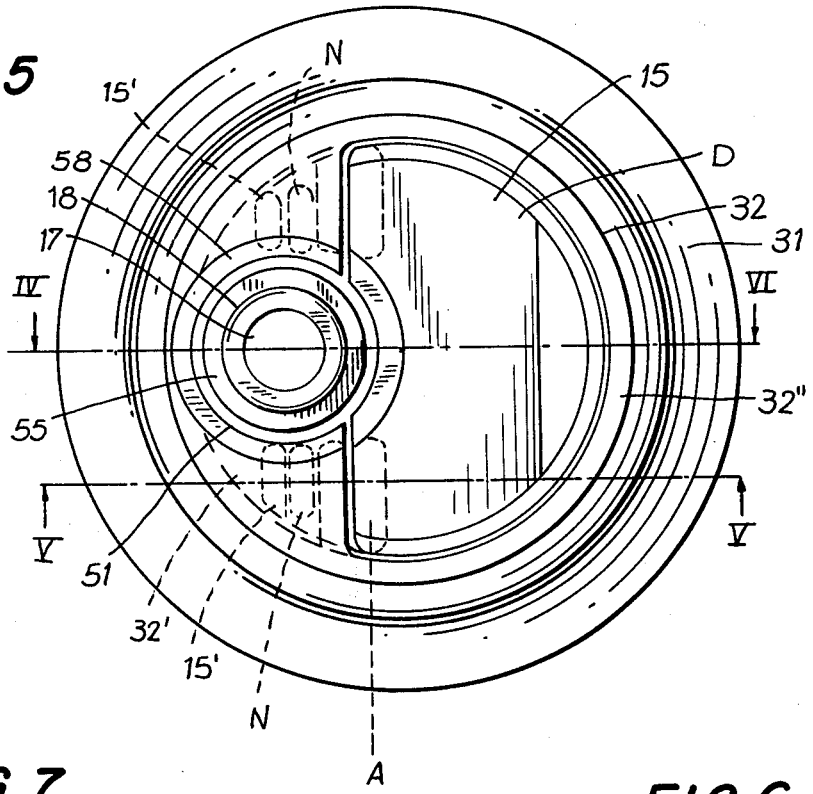
FIG. 5 is a top plan view of FIG. 3.
Figure 7:
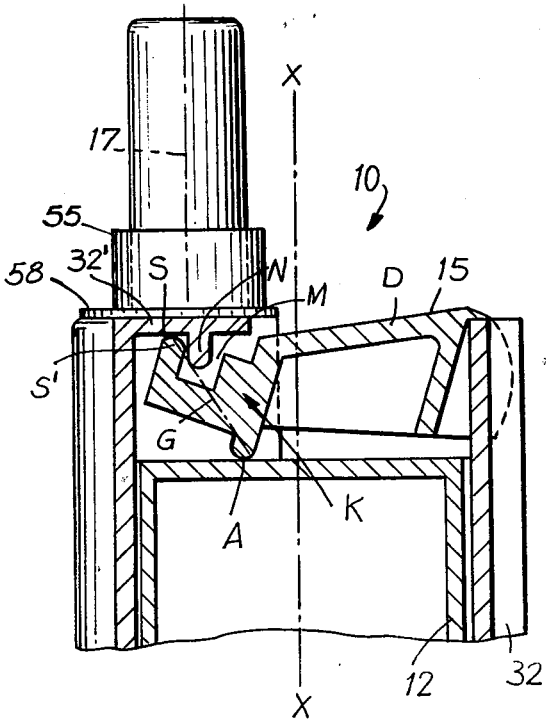
FIG. 7 is a longitudinal section along the line V—V in FIG. 5, and actuating position.
Figure 6:
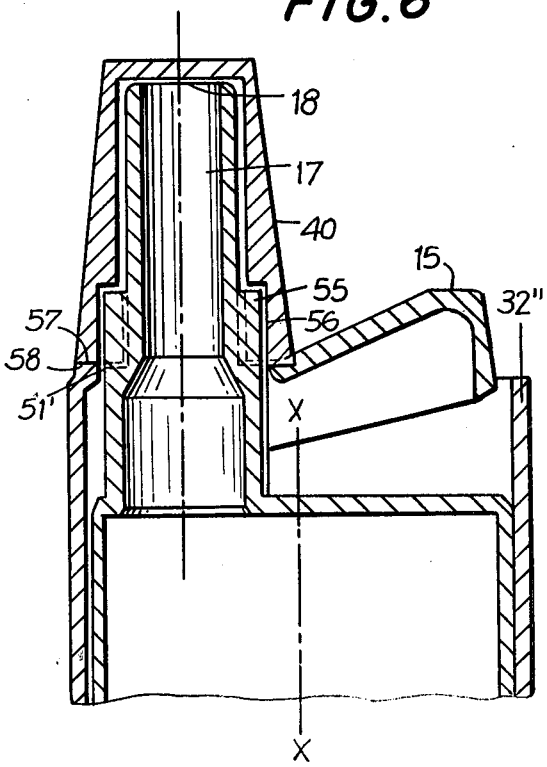
FIG. 6 is a longitudinal section along the line IV—IV in FIG. 5 with the dispenser in secured closing position.

From this the following mode of operation results: If a pressure is exerted on button 15 in the direction of arrow 49, be it that the dispenser 10 stands with its bottom 31 on a foundation, or be it that one takes the container part 32 serving as grip into the actuating hand, cylinder 12 is pushed downwardly relative to the container part 32. Since a pressure is exerted on the piston bottom in the same direction, the reeds 45 dig into the piston rod 41, so that piston 19 cannot be moved toward the container bottom 31. But because of the corresponding inclination of the outer reeds 46 of the reed spring 44, cylinder 12 can readily be brought down relative to the retained position 19. This causes the volume 50 containing the material 11 to be reduced, with the result that a portion of the material emerges from the opening 18 in an amount corresponding to the volume displaced. After application of the material, button 15 is released, and cylinder 12 is moved upwardly by spring 29. The outer reeds 46 of spring 44 then dig into the inner wall 23 of the cylinder, while the clamping wedge effect between the inner reeds 45 and the piston rod 41 ceases. Therefore piston 19 is brought back with the return of cylinder 12, the existing volume 50 remaining constant. This position now obtained differs from the starting position of FIG. 1 in that the piston 19 now stands one stroke length (dimension 38) above the original level. The return stroke of cylinder 12 is brought about by a topside stop 51 at the end of the container part 32, which stop 51 is formed as an inwardly pointing collar, to which is fitted an abutment shoulder 52 of cylinder 12 (FIG. 2).

The dispenser 10 according to the invention is designed for maximum evacuation of its interior. This applies in particular also to the upper end section 22. This is shown in FIG. 2. The illustration purports that when the cylinder 12 is fully depressed, the last possible portion has been ejected. In this position there is a minimum distance between the surface of piston part 20 and the underside of the upper closure 14 of cylinder 12. Essentially, therefore, there is material now only inside the dispensing tube 17. This is possible essentially due to the fact that the piston rod 41 has been brought up as far as possible and the piston can enter into the topmost section 22.

To assure the user after ejection of the last possible portion that the container is actually empty, the arrangement is such that with every additional pressure on pushbutton 15 the cylinder executes an idle stroke without the piston being moved on and without the piston being able to strike against the underside of the bottom for instance under simultaneous clamping action on the piston rod 41. The means which bring this about comprise firstly a slightly contracted section 53 in the end region of piston rod 41. The diameter of the contracted section 53 is such that the inner reeds 45 of spring 44, as soon as they reach this region, can no longer come into clamping contact with the piston rod 41. The length L of the contracted section 53 is somewhat greater than one stroke (dimension 38), and advantageously the contracted section begins at a distance A from the free end of the piston rod 41. This dimension A is somewhat greater than the distance Z between the clamping edges of the inner reeds 45 and a lip seal 54 disposed in the region of the piston buttom and in operative contact with the piston rod 41, including the contracted section 53.

Now when piston 19 gets into an upper position in which the inner reeds 45 come into the region of the contracted section 53 and thus lose contact with the piston rod 41, the sealing lips 54 are however still in abutment on the upper end section of piston rod 41, so that no material can pass downward through the bore in the piston bottom. If—starting from FIG. 2—cylinder 12 is allowed to ascend again, the piston is taken along through the clamp connection between the outer reeds 46 and the inner jacket 23 of the cylinder. But another pressure on button 15 now brings it about that the piston, since it can no longer take support on piston rod 41, is taken along down again without exertion of force. Naturally no content is transported out of ejection opening 18 any more. The user knows now that the container is empty.

In the example shown, a section 42 of normal dimension is present above the contracted section 53, to ensure optimum sealing between the lip seal 54 and this section 42. However, since it is demanded of the sealing lip 54 that it must seal also in the region of the contracted section 53, alternatively the latter could extend upwardly over the total length A.

After a completed return stroke (FIG. 1), cylinder 12 protrudes by its upper section 22 upwardly from the container part 32. Externally this section 22 is provided with a thread arrangement 55 which can cooperate with a counter-thread arrangement 56 on the corresponding interior side of the screw cap 40. At the same time the arrangement is such that the lower end face 57 of screw cap 40 is supported on the upper end face 58 of the container part 32. Since at least a grippable threaded shoulder protrudes from the container part 32 also in the depressed position of cylinder 12, it is thus possible, with the cap screwed on, to pull the cylinder 12 out of the container part 32 by means of the screwing movement. This may be advantageous in case that for some unforeseeable reasons the compression spring 28 alone should not be able to carry out the complete return stroke. Besides, the screw cap has a conical inner face 59 adapted to the inclination of the plane of the dispensing opening 18, the screw cap 40 having a dimension such that the conical surface 59 acting as seal makes contact on the annular end face 60 surrounding the mouth 61 of the dispensing opening 18 before the abutment areas 51 and 52 of cylinder 12 and container part 32 abut. Especially when cap 40 and/or tube 17 are made of elastic material, an especially reliable seal of the dispensing opening 18 takes place in that this connection is tightened by the cap 40 being screwed on.

Another preferred form of realization of the dispenser according to the invention is described in the following:

Foregoing direct actuation of the cylinder, a spreading element is inserted in the already existing gap between the two mutually movable basic components of the dispenser, namely the housing container and the cylinder. For this purpose the housing container is extended as a support abutment, spanning the top of the cylinder, to make room for an expansion wedge which forms the pushbutton actuation area and whose expansion area rests on the top. Such an expansion wedge can be laid out for optimum energy saving with respect to its actuation path, so that a longer actuation path goes along with a shorter displacement path of the cylinder. To be able to utilize for the exapnsion wedge the action of the return spring loading the cylinder and housing container in the direction of their basic position, it is of advantage that the connecting line extending obliquely to the displacement path of the cylinder between expansion area and support point of the wedge on the abutment does not go beyond the dead center position upon actuation of the toggle. A structurally favorable, captive association of the wedge results further through the fact that the support point lies behind a nose which is disposed on the underside of the support abutment oriented toward the topside of the bottom. The same objective is purused by the measure that the wedge is embraced at its pushbutton actuating end by the edge of the housing container. To protect the actuation mechanism from contacts causing accidental dispensing, the closure cap normally present on such dispensers is integrated as securing means and the respective design is such that the cylinder mouth formed by a tubular dispensing channel traverses the support abutment and is equipped beyond the support abutment with a screw cap seated on the topside of the support abutment. This blocks the relative movement of cylinder and housing container. The actuation area is approximately semi-circular. A circular dispenser cross-section results in an extremely large actuation area. Accordingly the actuating finger is freer as to direction. The operator handles the dispenser in the manner that seems most convenient to him. To achieve a balanced actuating pressure, the further design is to make the expansion wedge fork-shaped and to arrange the two fork tines on either side of the ejection channel.

A further advantageous solution concerning the expansion wedge is to give it the form of a sliding wedge displaceable crosswise to the length of the cylinder.

Another possibility is to form the expansion wedge as a rotary wedge. Such expansion elements in the form of an eccentric are easy to install, e.g. in that on the two relatively movable components, in the correlation region of the rotary wedge, bearing openings are formed which receive the rotary wedge axle and shift relatively to each other according to the control stroke. Such an axle consists advantageously of integrally formed axle ends.

With reference to FIGS. 3–7, dispenser marked 10 as a whole has a cylinder 12 receiving pasty material 11, such as toothpaste. The lower end 13 of cylinder 12 is open. At the top the cylinder terminates with an upper part 14. The topside of this part 14 is marked 14'.

From the upper part 14 there originates a dispensing channel 17 arranged eccentrically and oriented parallel to the longitudinal median axis x—x of the dispenser. The channel section immediately before the dispensing opening 18 is reduced in cross-section as compared with the lower channel section. The transitional region in the lower third has an external thread arrangement 55. The latter cooperates with a counter-thread arrangement 56 on the corresponding inner side of a screw cap 40. The latter fits with its lower annular end face 57 on the upper end face 58 of the cylindrical housing container 32.

The housing container is formed with a support abutment S extending over the topside 14' of the upper part 14 of cylinder 12. It is formed by a bottom section 32' of housing container 32 extending parallel to the upper part 14 of cylinder 12 and forms a passage 51' for the dispensing channel 17 forming a tubular mouthpiece of the dispenser. The diameter of the passage is such that when cap 40 has been removed, the mouthpiece is freely displaceable therein.

Between the support abutment S and topside 14' of upper part 14 of cylinder 12 is an expansion wedge K. Its expansion area A, which enlarges the distance y between S and 14', rests on the topside of 14. The basic position of the expansion wedge K is evident from FIG. 4.

The expansion wedge K is extended to form a freely accessible pushbutton 15. The latter's actuating area is marked D. As viewed from above, it is shown to be somewhat more than semicircular in form (see FIG. 5). For the movement of the pushbutton actuating end, the bottom section 32' forming the support abutment S is designed to present a passage-way, and also in the sense that the toggle movement of wedge K has the necessary freedom of movement relative to edge 32'' of housing container 32.

The end face of edge 32'' terminates at the same level as the bottom section 32' forming the support abutment S, while retaining the jacket form of cylinder 12.

The expansion area A lies in the region of the longitudinal median axis x—x of dispenser 10. The connecting line G between A and S' of the expansion wedge K extends at an inclination of about 50° to the shifting direction of cylinder 12; it does not go beyond the dead center position, so that the return spring 28 loading the cylinder and housing container 32 in the basic position, at the same time maintains the button 15 in the position ready for operation.

The connecting line G between A and S' is shorter than the pushbutton operating area of wedge K. The ratio is about 1:2.

The support point S' lies behind a nose N of S pointing housing-inwardly. The nose sits on the underside of this support abutment S and extends perpendicularly to the topside 14' of upper part 14. Nose N engages a cut-out M of a section of the expansion wedge forming the toggle and fixes the wedge undisplaceably. The latter is fork-shaped. The two fork tines 15' embrace the ejection channel 17 with a spacing y from the dispenser 10. The fork form is evident from FIG. 5.

The movement of the expansion wedge K pushes piston 19 in the direction of the ejection opening 18. The piston is pot shaped and is guided with integrally formed circling sealing lips 24, 25 on the inner wall 23 of cylinder 12.

A loosely inserted disk 27 is provided at the lower annular end face 26 of cylinder 12. The return spring 28 takes support on the underside thereof. It is a helical compression spring.

The second seat for the return spring 28 is closed by the inner side 30 of cover type bottom 31 which closes the housing container 32 from below and can be scraped on. The bottom carries at the same time the piston rod 41. The latter extends in the longitudinal media plane x—x of the dispenser 10 and ends at a distance before the inner side of bottom 4 of cylinder 12 which corresponds at least to the maximum actuation stroke by wedge K.

To be able to move piston 19 toward the dispensing opening 18 for the purpose of applying portions of material in stepwise movement, a reed spring 44 as in the previous embodiment is connected with the piston on the underside thereof by suitable, in particular ratchet, means; in an approximately radial arrangement it carries inner reeds 45 and outer reeds 46, the latter being held together by a common coupling ring 47. As can be seen, the inner reeds 45 as well as the outer reeds 46 are slightly inclined downwardly toward the inner side 30 of container 1. The inner reeds 45 can clamp-lock with the jacket 48 of piston rod 41, while the outer reeds 46 come into operative contact with the inner jacket 23 of cylinder 12. Disk 27 is pierced in the center for free passage of the piston rod 41.

There results the following function: When pressure is exerted in the direction of arrow 49 on pushbutton 15, area A of wedge K taking support on abutment S displaces the cylinder 12 in the direction of the container bottom 31. This relative displacement of cylinder 12 and housing container 32 expels a quantity of material 11 corresponding to the stroke. Always the same quantity is dispensed, because the underside of pushbutton 15 opposite the pushbutton actuating area D places itself on the topside 14' of the upper part 14 in an abutment-limiting manner. The connecting line marked G has thereby adopted a steeper position (FIG. 7), namely with slight displacement of area A on the topside 14' of 14 in the direction of the housing wall at that point. In this operation the piston 19 remains fixed due to the locking inner reeds 45 at piston rod 41. The outer reeds 46, instead, permit a downward sliding of the cylinder counter to spring force. Now if one releases the pushbutton 15, the outer reeds 46 will dig into the cylinder and the inner reeds 46 will slide up along the piston rod, namely due to the force of the return spring 28. Since, as has been explained above, the connecting line G between A and S' has not gone into or beyond the dead center position (shortest connection between S and 14' of 14), one and the same spring 28 causes also the establishment of the basic position for the pushbutton 15. If thereafter the screw cap 40 is applied again, so that the end face 57 comes up against the corresponding upper end face 58 of housing container 32, actuation of the pushbutton 15 is blocked.

Figure 8:
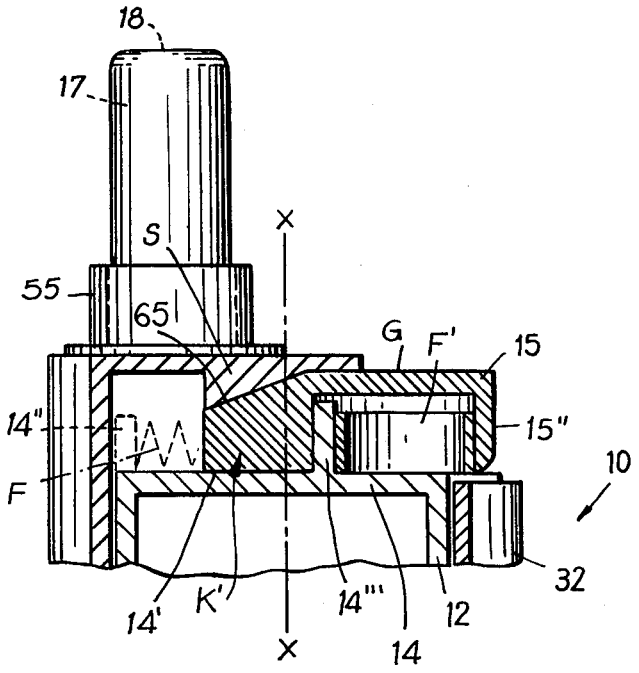
FIG. 8 is a cross-sectional view of the top of a dispenser according to a further embodiment.
Figure 9:
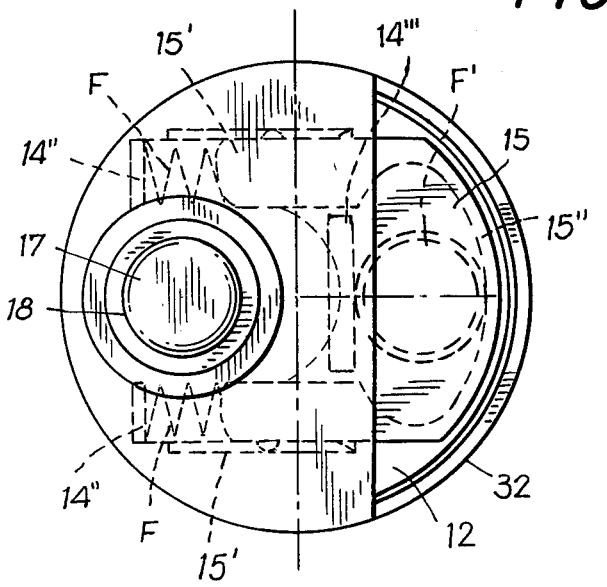
FIG. 9 is a top plan view of FIG. 8.

In the embodiment according to FIG. 8 and 9, a toggle type expansion wedge is replaced by a sliding wedge K' displaceable crosswise to the length of the cylinder. It rests on the topside 14' of the upper part 14 for crosswise displacement. Its upper side forms a wedge surface 65. The counter wedge surface is formed by the support abutment S spanning the topside 14' of 14. Here, too, a fork tine form has been employed. From the end faces of the fork tines 15' compression springs F mounted in blind bores of wedge K' protrude, which springs rest against abutments of cylinder 12 formed by upright lobes 14''. As the function is otherwise identical with the above explained example, a further representation and further exposition is dispensed with. The captive correlation of the sliding wedge K' can be obtained by way of the clip connection as seen from the plan view (FIG. 9). Instead of two compression springs F, a single annular spring F' can be provided between the backwall 15'' of wedge K' and a central upright lobe 14''' of cylinder 12, said upright lobe 14''' forming by its wedge-side area at the same time a limiting abutment for the sliding wedge K'. The backwall 15'' terminates with the wall of the cylinder. The wall of the housing container is there cut away for accessibility of operation.

Figure 11:
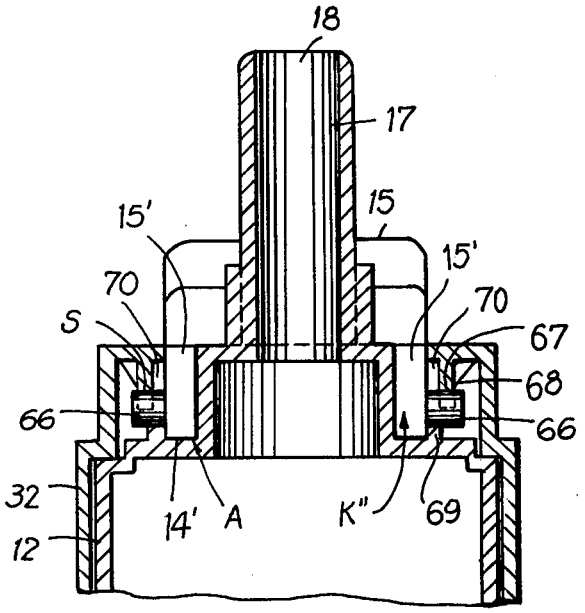
FIG. 11 is a transverse cross-sectional view along the lines IX—IX of FIG. 10.
Figure 10:
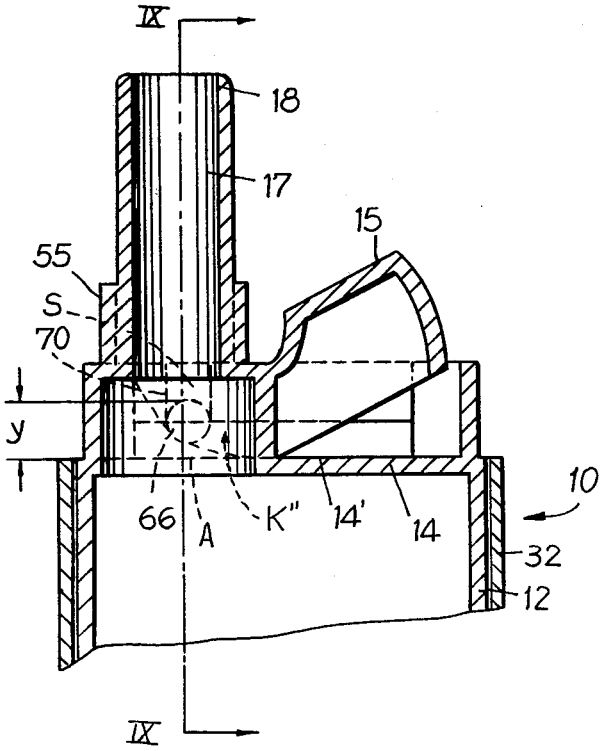
FIG. 10 is a cross-sectional view of a dispenser according to a still further embodiment.

The embodiment according to FIGS. 10 and 11 uses a rotary wedge K''. This expansion wedge acts like an eccentric load by its fork tines 15' forming curved skids on the topside 14'of the upper part 14 of the cylinder. Horizontally oriented support pins 66 are formed on the fork tines 15'. Also in this realization the housing container 32 is extended in a support abutment S for the rotary wedge K'', constituting the pushbutton actuation area, the area A of which rests on the topside 14' of 14. The support pins 66 lie in a bearing opening 67 porportionally formed by the container housing 32 and by the cylinder 12. The oppositely oriented bearing lobes 68, 69 overlap (FIG. 11). One bearing trough is extended upwardly in an open plug shaft or chute, which guides the support pin 66 when the cylinder 12 is being pushed upward.

We claim:

1. Dispenser for the portionwise dispensing of a material, in particular a paste, e.g. toothpaste, having a cylinder within which a piston moves stepwise relative to the cylinder in the direction toward a dispensing opening, while in the opposite direction it is clampable on the inner wall of the cylinder by means of a clip type reed spring arranged thereon, the dispensing opening being disposed at the same end of the dispenser at which pressure is to be applied, characterized in that the cylinder has a seat on its underside and is mounted for longitudinal displacement against the action of a helical compression return spring which is supported between the bottom of a housing container comprising a cylindrical body having a closed bottom to which a piston rod is firmly attached at its lower end, and the seat on the underside of said cylinder, the clip type reed spring supporting said piston relative to said piston rod in such a way that when pressure on the top side of the cylinder causes the dispensing of a portion, the piston is fixed to the piston rod, while during the end stroke of the cylinder the piston is fixed to the cylinder, and an abutment at the upper end of said cylindrical body limiting the return stroke of said cylinder, and in which the upper end of said piston rod is spaced beneath the top of the cylinder at a distance which is slightly greater than the downward stroke distance of the cylinder, a lip seal on said piston engaging said piston rod, said piston rod having a contracted section at a predetermined distance from its upper end, said contracted section having a length shorter than said predetermined distance, said predetermined distance in turn being greater than the distance from said lip seal to the zone of engagement of said clip type reed spring with said piston rod, and said length being slightly greater than the downward stroke distance of said cylinder.

2. Dispenser according to claim 1, characterized in that the seat on the underside of the cylinder comprises a disk pressing against the annular end face of the cylinder, against which the upper end of the return spring is applied.

3. Dispenser according to claim 2, characterized in that for stroke limitation a collar cooperating with the disk is formed on the inner side of the container bottom to limit the downward stroke of the cylinder.

4. Dispenser according to claim 1, characterized in that the clip type reed spring is a single double action reed spring.

5. Dispenser according to claim 4, characterized in that the reeds of the reed spring, starting from a central annular section interconnecting the reeds, are on one side directed substantially radially inward toward the piston rod and on a second side radially outward toward the cylinder at an acute angle to the rotation symmetry axis of the reed spring and are inclined with their free ends in the direction of the container bottom.

6. Dispenser according to claim 1, characterized in that the container is extended to form a support abutment which extends over the upper part of the cylinder, in combination, a push button and an expansion wedge which in turn forms an output actuating surface of the push button, said expansion wedge contacts the support abutment and rests on the upper part of the cylinder.

7. Dispenser according to claim 6, characterized in that the expansion wedge is formed as a sliding wedge displaceable crosswise with respect to the cylinder length.

8. Dispenser according to claim 6, characterized in that the expansion wedge is formed as a rotary wedge.

9. Dispenser according to claim 1, characterized in that the container is extended to form a support abutment which extends over the upper part of the cylinder, in combination, a push button and an expansion wedge which in turn forms an output actuating surface of the push button, said expansion wedge having a downward extension increasing the distance between the expansion wedge and the top of the upper part of the cylinder on which it rests.

10. Dispenser according to claim 9, characterized in that the expansion wedge is fork-shaped, and the two fork tines are disposed on either side of an ejection channel.

11. Dispenser according to claim 9, characterized in that the dispensing opening is formed by a tubular ejection channel extending from the cylinder and through the support abutment, in combination with a screw cap fitting on the top of the support abutment.

12. Dispenser according to claim 9, characterized in that the pushbutton-actuating end of the expansion wedge is enclosed by an edge of the housing container.

13. Dispenser according to claim 12, characterized in that the pushbutton-actuating surface is approximately semicircular.

14. Dispenser according to claim 9, characterized in that a connecting line drawn between the contact point of said expansion wedge with said support abutment and the contact point of said downward extension of said expansion wedge with the upper part of said cylinder is an inclined line from which said expansion wedge does not go beyond dead center upon actuation of said push button.

15. Dispenser according to claim 14, characterized in that the extension of said container forming said support abutment is provided with a downwardly dependent nose and said expansion wedge is formed with a cut-out section receiving said nose, and in which the contact-point between said expansion wedge and said support abutment lies along said inclined line behind said nose.

16. Dispenser according to claim 1, characterized in that on the outside of the cylinder and on the inside of the container, matching parts are provided to prevent the relative rotation of the same.

17. Dispenser according to claim 16, characterized in that the cylinder has at its upper outer end a thread arrangement engageable with a counter-thread arrangement of a screw cap.

18. Dispenser according to claim 17, characterized in that a lower annular end face of the screw cap is supported on an upper end face of the container.

19. Dispenser according to claim 18, characterized in that in the screwed-on position the screw cap covers the mouth of the dispensing opening.

* * * * *